US008784124B2

(12) United States Patent
Yeon

(10) Patent No.: US 8,784,124 B2
(45) Date of Patent: Jul. 22, 2014

(54) CONNECTOR IN ELECTRIC VEHICLE CHARGER

(71) Applicant: LS Cable & System Ltd., Anyang-si (KR)

(72) Inventor: Kyu Yeon Yeon, Seongnam-si (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 0 days.

(21) Appl. No.: 13/775,982

(22) Filed: Feb. 25, 2013

(65) Prior Publication Data

US 2013/0316559 A1 Nov. 28, 2013

(30) Foreign Application Priority Data

May 23, 2012 (KR) ..... 10-2012-0054764

(51) Int. Cl.
*H01R 4/50* (2006.01)

(52) U.S. Cl.
USPC ..... 439/299; 439/345

(58) Field of Classification Search
USPC ..... 439/34, 35, 175, 299, 352–357, 372, 439/345
See application file for complete search history.

(56) References Cited

U.S. PATENT DOCUMENTS

| | | | | |
|---|---|---|---|---|
| 5,490,790 | A * | 2/1996 | Okada | 439/141 |
| 8,016,604 | B2 * | 9/2011 | Matsumoto et al. | 439/304 |
| 8,123,535 | B1 * | 2/2012 | Yeon | 439/101 |
| 8,562,370 | B2 * | 10/2013 | Takagi et al. | 439/345 |
| 2013/0303006 | A1 * | 11/2013 | Casses et al. | 439/135 |

* cited by examiner

*Primary Examiner* — Khiem Nguyen
(74) *Attorney, Agent, or Firm* — Sherr & Jiang, PLLC

(57) ABSTRACT

The present invention relates to a connector in an electric vehicle charger, and more particularly, to a connector in an electric vehicle charger, in which a structure thereof is improved for simplifying the same, minimizing a number of components, enabling to secure reliability in stages of mounting, charging, and coupling/decoupling, and improving durability, a water proof performance, and user's convenience.

20 Claims, 9 Drawing Sheets

CONNECTOR IN ELECTRIC VEHICLE CHARGER

CROSS REFERENCE TO RELATED APPLICATION

This application claims the benefit of the Patent Korean Application No. 10-2012-0054764, filed on May 23, 2012, which is hereby incorporated by reference as if fully set forth herein.

BACKGROUND OF THE DISCLOSURE

1. Field of the Disclosure

The present invention relates to a connector in an electric vehicle charger, and more particularly, to a connector in an electric vehicle charger, in which a structure thereof is improved for simplifying the same, minimizing a number of components, enabling to secure reliability in stages of mounting, charging, and coupling/decoupling, and improving durability, a water proof performance, and user's convenience.

2. Discussion of the Related Art

According to recent global environmental regulation strengthening and energy cost reducing trend, demands on environment friendly EV (Electric Vehicle) is increasing. The USA and the Europe are in a state in which supply of the electric vehicle is obliged by legislation of the clean air act, and, in the Korea, interest in, and research on, green car is active as a part of low carbon green growth activity, too.

The electric vehicle is provided with a motor for driving the vehicle, and a battery for operating various electric units.

In order to expand propagation of the electric vehicles, it is essential to construct an electricity charge infrastructure which can charge the electric vehicles. Particularly, since en increase of a battery charge capacity of the electric vehicle increases weight of the vehicle itself, a running range of the electric vehicle with one time of full charging can not but be limited. Therefore, it is essential to install, including domestic charging equipment, an adequate number of charging stations for the electric vehicles to charge at anytime and anywhere during a long distance running.

For the charging, the electric vehicle is provided with an inlet at a body thereof, and the charging station is provided with a power supply side connector to be coupled to the inlet selectively for transfer of electric energy to the electric vehicle.

In the meantime, since the connector in the electric vehicle charger is mounted to an outside that is vulnerable to an environment, such as rain or snow, allowing infiltration of water into internal electric components of the connector to cause fault or a safety hazard to a user, the connector is required to have a structure which can provide a good water proof performance, and convenience of use.

Moreover, the connector is required to have a simple structure, be able to minimize a number of components, meet safety or rule and regulation requirements, and have reliability not to be decoupled during the charging unintentionally, and does not require strong force for coupling or decoupling.

SUMMARY OF THE DISCLOSURE

Accordingly, the present invention is directed to a connector in an electric vehicle charger.

An object of the present invention is to provide a connector in an electric vehicle charger, in which a structure thereof is improved for simplifying the same, minimizing a number of components, enabling to secure reliability in stages of mounting, charging, and coupling/decoupling, and improving durability, a water proof performance, and user's convenience.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a connector in an electric vehicle includes an outer housing, a terminal assembly including a terminal housing slidably mounted in the outer housing to be movable forward or backward, a handle mounted to the outer housing for receiving a cable electrically connected to the terminal assembly therein, a slider connected to the terminal assembly and slidably mounted in the outer housing to be movable forward or backward, a lever mounted to the outer housing to be rotatable in a first direction or a second direction for making the slider to move forward or backward, a first locking unit for preventing the slider from moving backward when the slider is moved forward, a second locking unit for securing the slider in response to an electric signal selectively when the slider is moved forward, and an unlocking button for separating the first locking unit from the slider by pressing the first locking unit.

In another aspect of the present invention, a connector in an electric vehicle charger includes an outer housing, a terminal assembly including a terminal housing slidably mounted in the outer housing to be movable forward or backward, a handle mounted to the outer housing for receiving a cable electrically connected to the terminal assembly therein, a slider connected to the terminal assembly and slidably mounted in the outer housing to be movable forward or backward, a lever mounted to the outer housing to be rotatable in a first direction or a second direction for making the slider to move forward or backward, a first locking unit for preventing the slider from moving backward when the slider is moved forward, an unlocking button for separating the first locking unit from the slider by pressing the first locking unit, and a latch for selectively coupling the outer housing to an inlet of the electric vehicle as the terminal housing slides.

As has been described, the connector in an electric vehicle charger related to an embodiment of the present invention has a structure thereof improved for simplifying the same, minimizing a number of components, enabling to secure reliability in stages of mounting, charging, and coupling/decoupling, and improving durability, a water proof performance, and user's convenience.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

A connector in an electric vehicle charger (Hereafter called as "connector") in accordance with a preferred embodiment of the present invention will be described with reference to the attached drawings. The attached drawings illustrate exemplary modes of the present invention, provided for describing the present invention in more detail, but not for limiting technical scopes of the present invention.

And, regardless of drawing numbers, identical corresponding elements will be given the same reference numbers, and repetitive description of which will be omitted. For convenience of description, a size or a shape of an element may be exaggerated or reduced.

In the meantime, though terms including ordinal numbers, such as first or second, can be used for describing various elements, the elements are not confined by the terms, and are used only for making one element distinctive from other elements.

Figure 1:
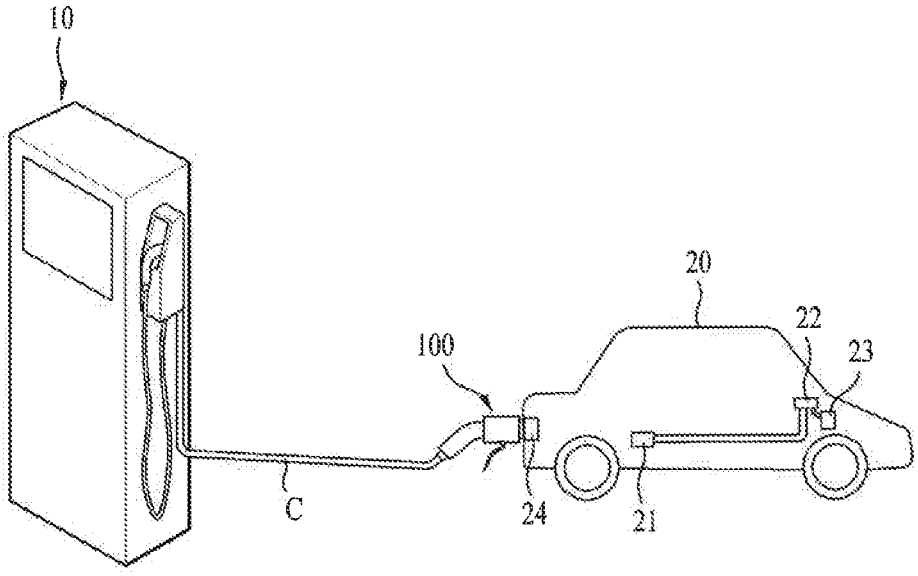
FIG. 1 illustrates a conceptual drawing for describing one operation states of a connector in an electric vehicle charger related to a preferred embodiment of the present invention.

FIG. 1 illustrates a conceptual drawing for describing one of operation states of a connector 100 in an electric vehicle charger related to a preferred embodiment of the present invention.

Referring to FIG. 1, a charging station 10 includes a body having a power rectifier, and a cable C electrically connected to the power rectifier and to be pulled out of the body. The cable C has the connector 100 mounted to an end thereof for placing in an inlet 24 in an electric vehicle 20.

The connector 100 has power supplied thereto from the charging station 10 through the cable C for charging the electric vehicle 20. The charging station 10 can charge the electric vehicle 20 through the connector 100 connected thereto with the cable C, and the electric vehicle 20 may include the inlet 24 to be coupled to the connector 100, a battery 21, inverter 22 and a driving motor 23.

Figure 2:
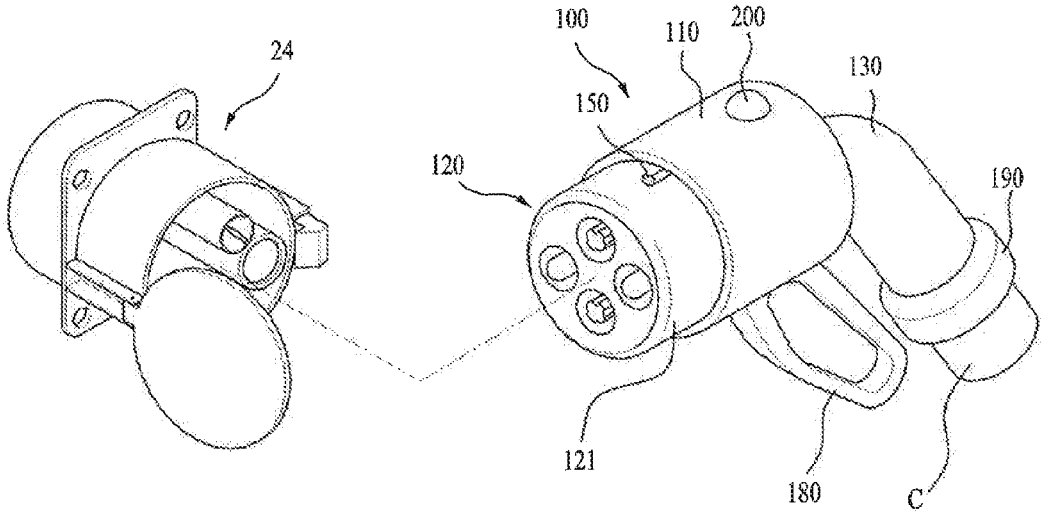
FIG. 2 illustrates a perspective view of a connector in an electric vehicle charger and an inlet related to a preferred embodiment of the present invention.
Figure 3:
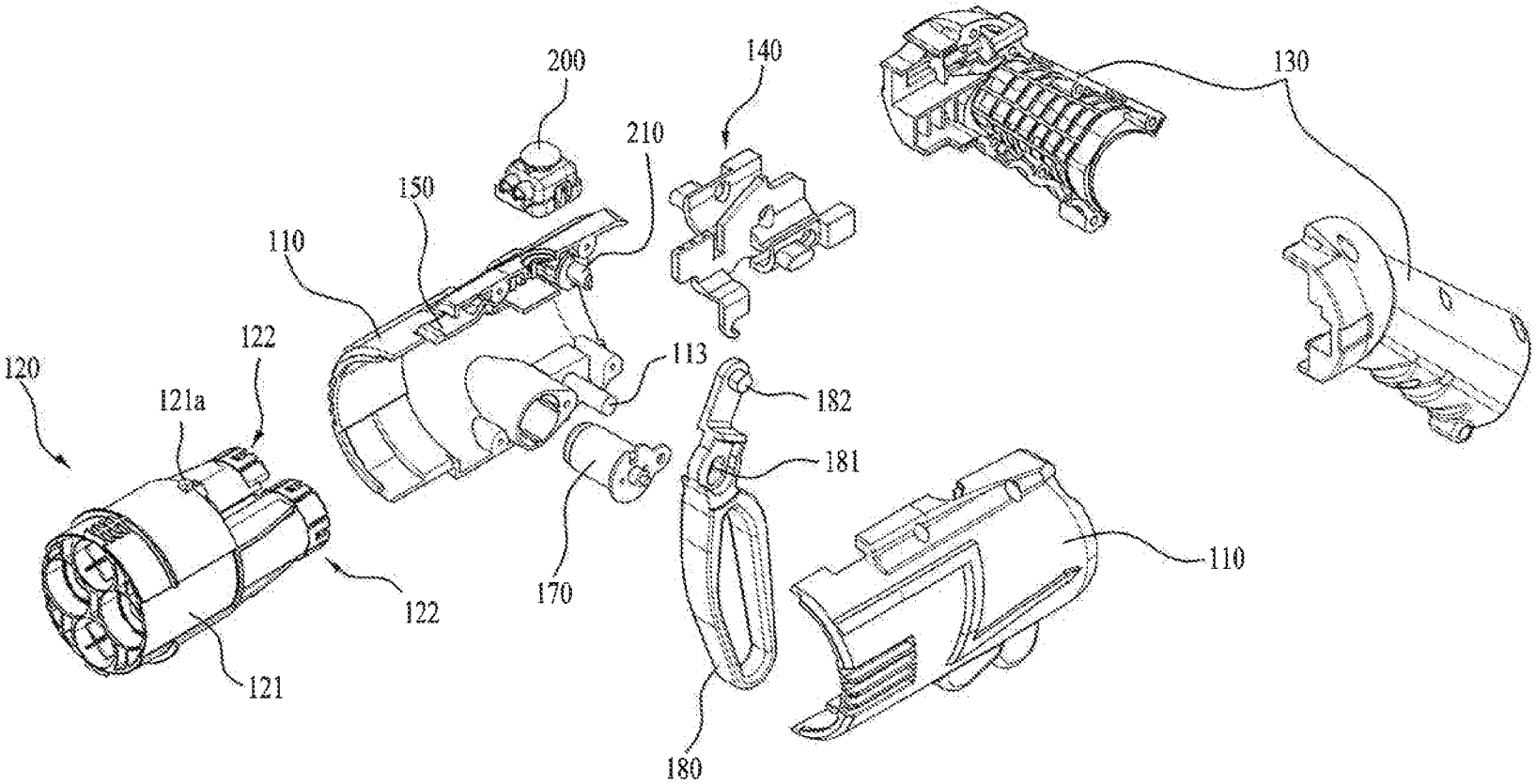
FIG. 3 illustrates an exploded perspective view of a connector in an electric vehicle charger related to a preferred embodiment of the present invention.
Figure 4:
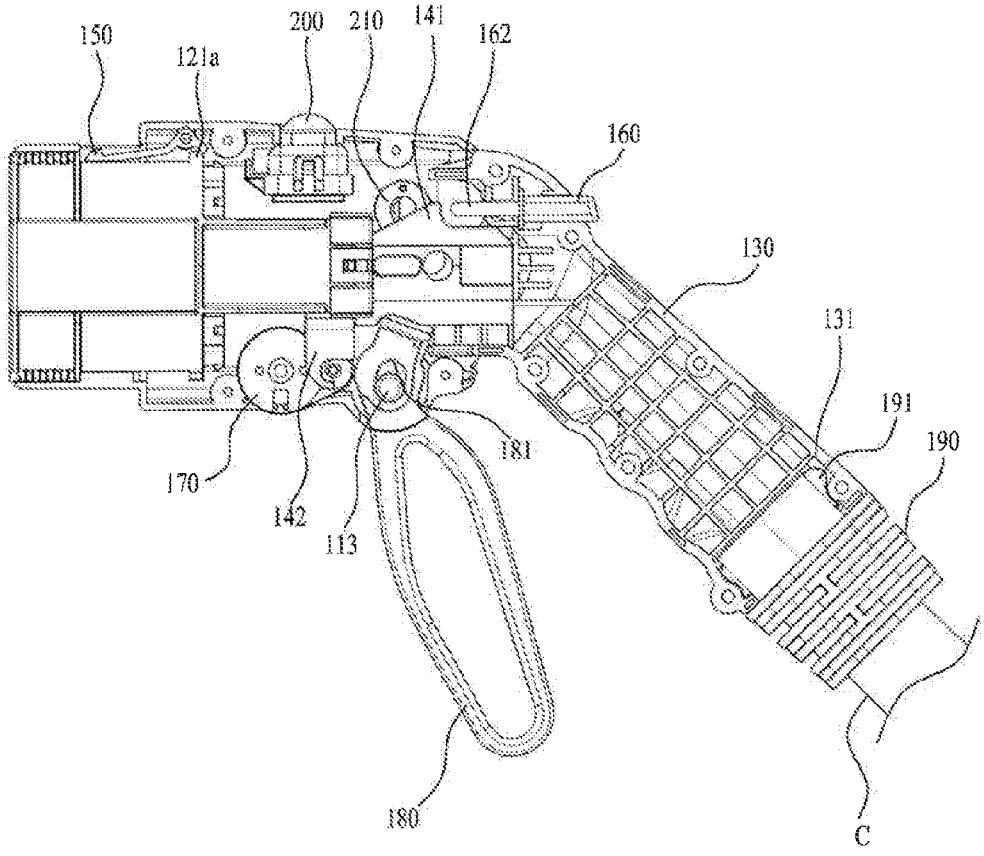
FIG. 4 illustrates a longitudinal section of a connector in an electric vehicle charger related to a preferred embodiment of the present invention.

FIG. 2 illustrates a perspective view of a connector in an electric vehicle charger and an inlet related to a preferred embodiment of the present invention, FIG. 3 illustrates an exploded perspective view of a connector in an electric vehicle charger related to a preferred embodiment of the present invention, and FIG. 4 illustrates a longitudinal section of a connector in an electric vehicle charger related to a preferred embodiment of the present invention.

Figure 5:
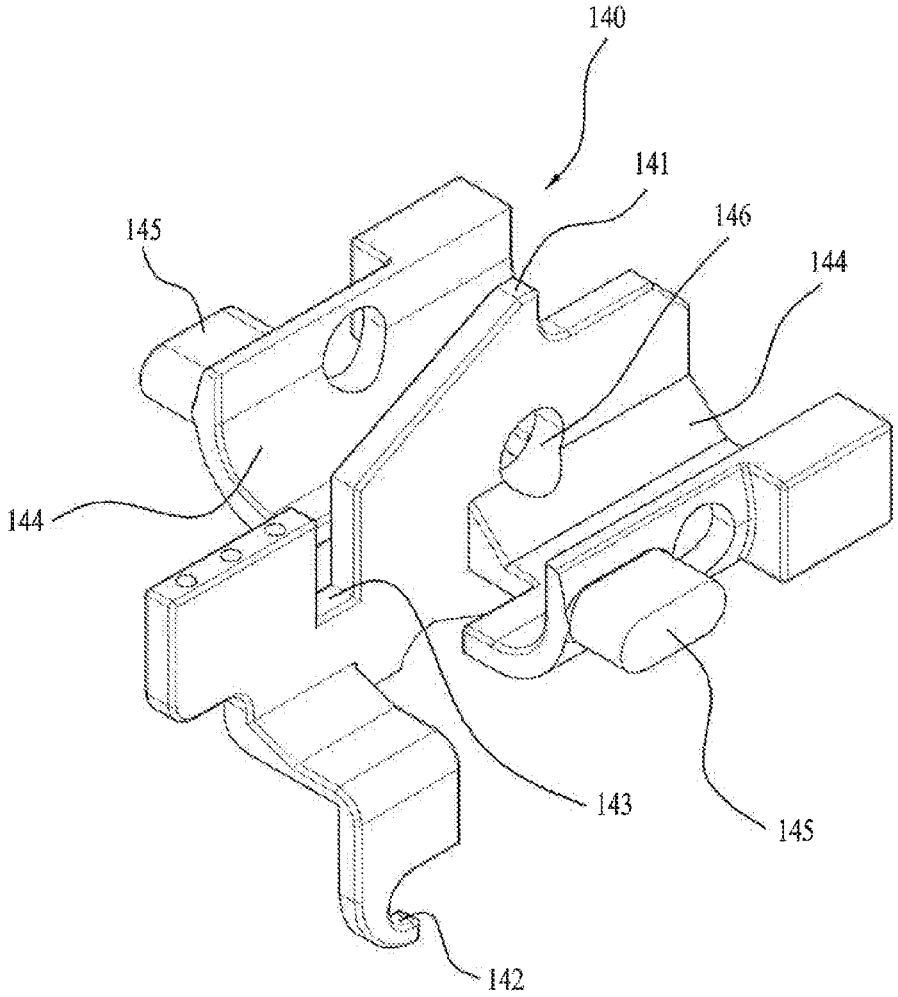
FIG. 5 illustrates a perspective view of a slider in a connector in an electric vehicle charger related to a preferred embodiment of the present invention.
Figure 6:
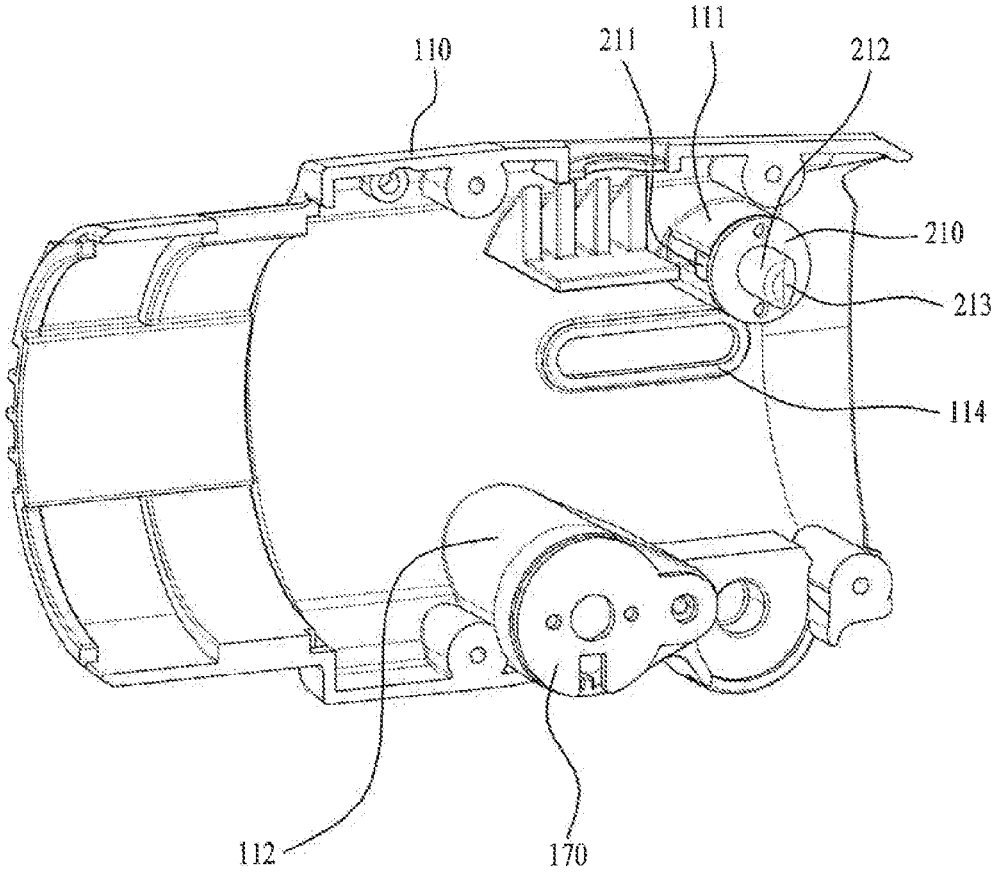
FIG. 6 illustrates a perspective view of key parts showing a first, locking member and a second locking member in a connector in an electric vehicle charger related to a preferred embodiment of the present invention.

And, FIG. 5 illustrates a perspective view of a slider in a connector in an electric vehicle charger related to a preferred embodiment of the present invention, and FIG. 6 illustrates a perspective view of key parts showing a first locking member and a second locking member in a connector in an electric vehicle charger related to a preferred embodiment of the present invention.

Figure 7:
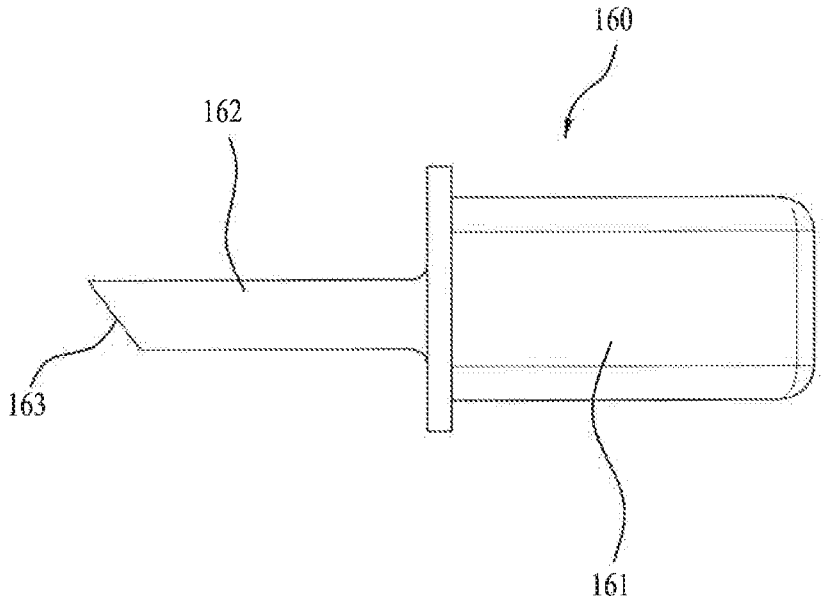
FIG. 7 illustrates a perspective view of an unlocking button in a connector in an electric vehicle charger related to a preferred embodiment of the present invention.
Figure 8:
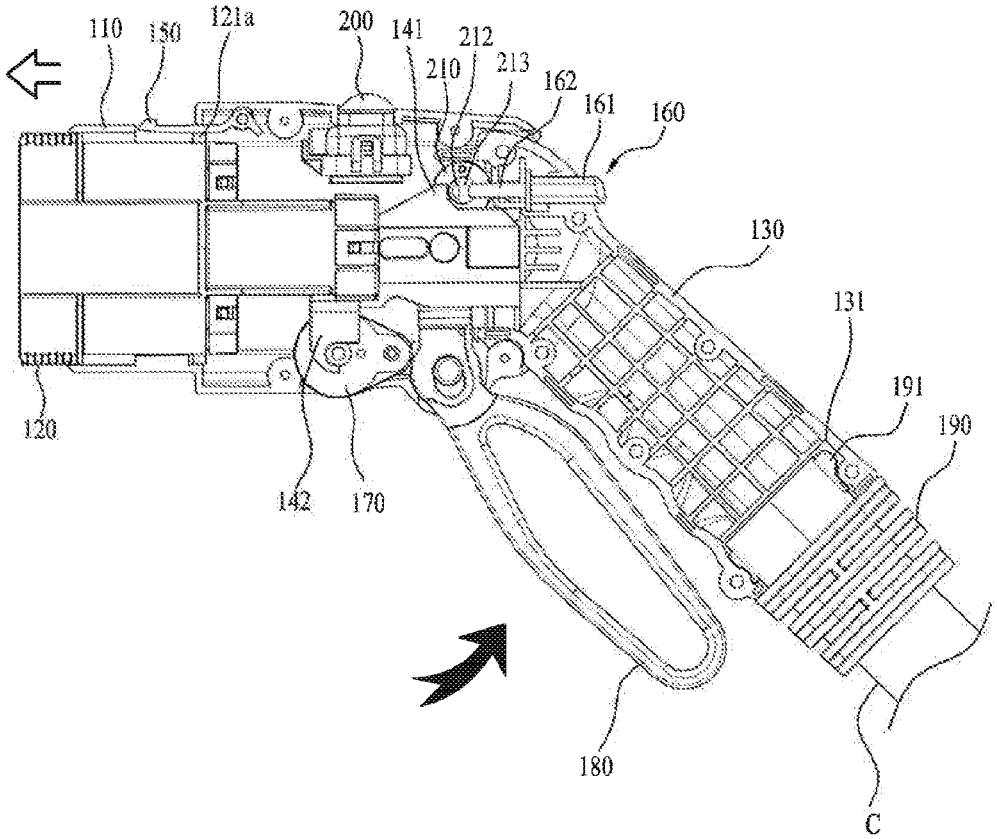
FIGS. 8 and 9 illustrate longitudinal sections each for describing one of operation states of a connector in an electric vehicle charger related to a preferred embodiment of the present invention.
Figure 9:
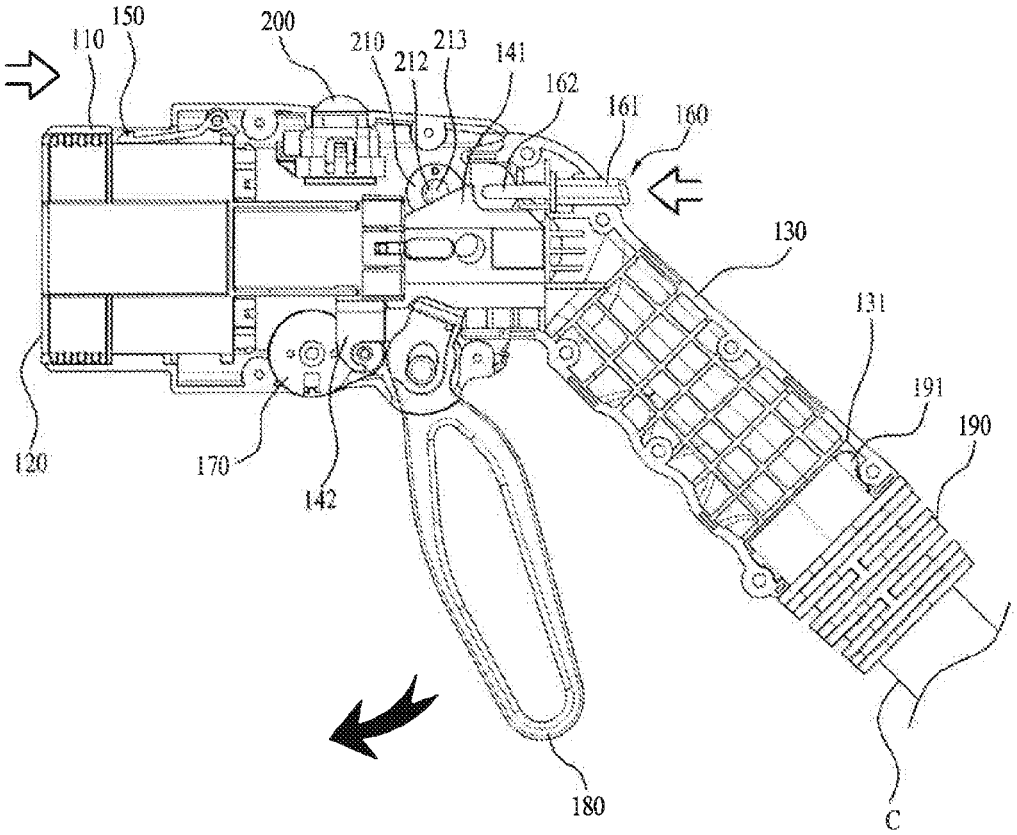

And, FIG. 7 illustrates a perspective view of a release button in a connector in an electric vehicle charger related to a preferred embodiment of the present invention, and FIGS. 8 and 9 illustrate longitudinal sections each for describing one of operation states of a connector in an electric vehicle charger related to a preferred embodiment of the present invention.

The connector 100 related to a preferred embodiment of the present invention includes an outer housing 110, a terminal assembly 120, a handle 130, a lever 180, and a slider 140.

In more detail, the connector 100 includes an outer housing 110, a terminal assembly 120 mounted in the outer housing 100 to have a terminal housing 121 slidably mounted to be movable forward or backward, a handle 130 mounted to the outer housing 110 to receive a cable C connected to the terminal assembly 120 electrically therein, and a slider 140 connected to the terminal assembly 120 and slidably mounted to an inside of the outer housing 110 to be movable forward or backward.

Also, the connector 100 includes a lever 180 mounted to the outer housing 110 to be rotatable in a first direction or a second direction for making the slider 140 to move forward or backward, a first locking unit 210 for preventing the slider 140 from moving backward when the slider 140 is moved forward, a second locking unit 170 to be coupled/decoupled to/from the slider 140 selectively by an electric signal when the slider 140 is moved forward, and an unlocking button 160 for decoupling the first locking unit 210 from the slider 140 by pressing the first locking unit 210.

Members of the connector 100 related to the present invention will be described with reference to the attached drawings, in detail.

Referring to FIGS. 3 and 6, the outer housing 110 may have a cylindrical hollow shape with opened front and rear ends, the front end with the terminal housing 121 slidably mounted thereto to be movable in the forward or the backward, the rear end with the handle 130 mounted thereto, and the lever 180 mounted thereto for pushing or pulling the slider 140 forward or backward.

Also, the outer housing 110 may have a guide slot 114 provided therein in a sliding direction of the slider 140 for guiding slide of the slider 140, a boss 111 of the first locking unit 210 provided thereto, and a mounting portion 112 provided thereto for mounting the second locking unit 170.

Also, the outer housing 110 has a shaft 113 mounted thereto for making the lever 180 to rotate.

And, the lever 180 may have a slot 181 provided thereto, the outer housing 110 may have a mounting projection 113 passed through a slot 181 provided thereto. The slot 181 may be rectangular formed tilted from the sliding direction of the terminal housing 121.

The connector 100 provides driving force for making the slider 140 and the terminal assembly 120 to slide forward or backward within the outer housing 110 with rotating momentum of rotating movement of the lever 180.

A structure of the slider 140 will be described with reference to the attached drawings, in detail.

Referring to FIG. 5, as described before, the slider 140 may be slidably mounted to the outer housing 110, and may include an inserting slot 143 for inserting to a rear of the terminal assembly 120, a pass through hole 146 for rotatable mounting of the lever 180 therein, and a plurality of slide projections 145 slidably mounted to be movable in the outer housing 110.

As described before, the slide projections 145 are placed in the guide slot 114 in the outer housing 110, and the lever 180 has a mounting projection 182 for placing in the pass through hole 146 in the slider 140.

The slider 140 may also include a seating portion 144 having a shape which surrounds a portion of each of one pair of power terminals 122 in the terminal assembly 120. The seating portion 144 may have a "W" cross section for isolating the one pair of the power terminals 122 from each other. The slider 140 may also include a first book portion 141 to couple to the first locking unit 210, and a second hook portion 142 to couple to the second locking unit 170.

Each of the hook portions 141 and 142 may have a variety of shapes as far as the shapes have a structure that can secure a position of the slider 140 owing to the locking unit 210 and 170. As a variation of the hook portions 141 and 142, the first hook portion 141 may be a projection extended upward from the seating portion 144, and the second hook portion 142 may be a projection having a shape which surrounds a portion of the second locking unit 170.

In this case, it is possible to provide the first hook portion 141 to position above the seating portion 144, and the second hook portion 142 to position below the seating portion 144.

The first locking unit 210 may include a boss 111 in the outer housing 110, an elastic member (Not shown) in the boss 111, and a locking pin 212 mounted in the boss 111 to be able to reciprocate within the boss 111 owing to the elastic member. The elastic member may be a coil spring, and the locking pin 212 is arranged in a state in which one end thereof is arranged in the boss 111 and the other end 213 thereof is projected to an outside of the boss 111.

In this case, the locking pin 212 is arranged to reciprocate in a direction perpendicular to a direction of sliding movement of the slider, so that the locking pin 212 moves to an inside of the boss 111 in a direction moving away from the slider 140 when the slider 140 slides to move forward, and projects in a direction of the slider 140 once the sliding movement of the slider 140 is completed.

The locking pin 212 is in contact with the slider 140 in a state the locking pin 212 is positioned at a rear of the slider 140 when the sliding movement of the slider 140 is completed. In this case, as described before, the locking pin 212 supports the first hook portion 141 of the slider 140 from a rear thereof, preventing the slider 140 from moving backward.

In the meantime, the other end 213 of the locking pin 212 which is in contact with the slider 140 when the slider 140 slides has a sloped surface, such that the slider 140 moves forward in a state the slider 140 is in contact with the sloped surface 213. In this structure, since the slider 140 presses the sloped surface 213 when the slider 140 slides forward, the locking pin 212 is pushed into an inside of the boss 111, enabling the slider 140 to slide forward.

In the meantime, the unlocking button 160 may be arranged to pass through a rear end portion of the outer housing 110 such that the unlocking button 160 is slidable in a direction of slide of the slider 140.

The unlocking button 160 also has a portion 161 projected to an upper side of a rear end portion of the outer housing 110 where the handle 130 is mounted, for the user to press the portion 161 to operate the unlocking button 160. The unlocking button 160 may have the other portion 162 having a pin shape extended toward the locking pin 212, with a sloped surface 163 formed to match with the sloped surface 213 of the locking pin 212.

In this case, if the user presses the unlocking button 160 to press the locking pin 212, the locking pin 212 moves into the boss 111, and if the locking pin 212 is separated from the first hook portion 141 of the slider 140, the slider 140 can slide backward.

In the meantime, if the slider 140 and the terminal assembly 120 slide to a front of the outer housing 110 by first direction rotation of the lever 180 for charging, it is required to secure a position of the terminal assembly 120 which is slid to the front for preventing the terminal assembly 120 from separating from the inlet 24 in a stage of the charging, freely. That is, even in a case the user presses the unlocking button 160 by mistake, it is required to prevent the terminal assembly 120 from sliding backward to be separated from the inlet 24 in the stage of the charging.

For this, the second locking unit 170 may be a solenoid 170 to be coupled to the second hook portion 142 in response to an electric signal, selectively.

In detail, if the terminal assembly 120 is connected to the electric vehicle electrically, the solenoid 170 is coupled to the second hook portion 142 of the slider 140, preventing the slider 140 from sliding backward.

In the meantime, the solenoid 170 is driven by the electric signal, and, as a variation, it may be possible to make a control unit in the electric vehicle 20 or the charging station 10 to control the solenoid 170 secured to the hook portion 142 in conformity with each other if the inlet 24 and the terminal assembly 120 are connected to each other.

And, upon finishing the charging, the solenoid 170 may be separated from the second hook portion 142 in response to an electric signal, to turn the terminal assembly 120 and the slider 140 into a state in which the terminal assembly 120 and the slider 140 can slide backward by a second direction rotation of the lever 180.

And, the connector 100 may include a light source 200 additionally for indicating a charging state if the terminal assembly 120 is connected to the electric vehicle 20, electrically. In this case, the light source 200 may have single color, and may indicate a charging state, a finished state, or an error state with on/off, or fixed patterns of flashing. Different from this, a plurality of the light sources 200 may be provided to have colors different from one another. As one example, a red light is made to be turned on in the charging, and a green light is made to be turned on upon finishing the charging, so that the user determines the charging state, easily.

In the meantime, as the terminal assembly 120 slides forward or backward, tension is liable to be applied to the cable C connected to the power terminals 122, electrically. That length of the cable C in the outer housing 110 is liable to increase or decrease as much as the slide of the terminal assembly 120.

In order to prevent this, the connector 100 may include a cable holder 190 slidably mounted to a rear end of the handle 130 to receive the cable C therein.

When the terminal assembly 120 moves forward, the cable holder 190 may slide toward the handle 130, and when the terminal assembly 120 moves backward, the cable holder 190 may slide in a direction of moving away from the handle 130. The cable holder 190 may be formed of at least one of rubber and plastic.

For an example, the cable holder 190 may have a portion in direct contact with the cable C formed in a shape of bellows of soft rubber, and another portion which slides in the handle formed of rigid resin.

As an example, the cable holder 190 may have a holding projection 191 provided thereon, and, provided to the handle 130, there may be a guide for the holding projection 191 to slide thereon, and a stopper 131.

Eventually, owing to securing a length of the cable C housed in the outer housing 110 as much as a distance of the slide of the terminal assembly 120 with the slide of the cable holder 190 enables to prevent the application of tension to the cable C from taking place.

When the terminal, assembly 120 moves forward, the cable holder 190 slides toward the handle 130, and, when the terminal assembly 120 moves backward, the cable holder 190 slides in a direction of moving away from the handle 130. Consequently, the cable C can slide as much as a slide distance of the terminal assembly 120.

The connector 100 may also include a latch 150 for maintaining a coupled state of the outer housing 110 to the electric vehicle 20 in a case the terminal assembly 120 is connected to the electric vehicle 20 (More specifically, the inlet), electrically.

The latch 150 may be pivotally mounted to the outer housing 110, and the terminal housing 121 may have a holding projection 121*a* extended toward the latch 150.

In this case, as the holding projection 121*a* is brought into contact with the latch 150 when the terminal housing 121 slides forward, the coupling state of the latch 150 can be maintained. That is, as the terminal housing 121 slides, the latch 150 and the holding projection 121*a* turn to a contact state, and, in a state the slide movement of the terminal housing 121 is finished, the holding projection 121*a* can maintain a state in which the latch 150 is placed inside of the inlet 24 of the electric vehicle 20.

Different from this, as the latch 150 moves away from the holding projection 121*a* when the terminal housing 121 slides backward, the coupling state of the latch 150 can be released. In this case, the coupling state of the latch 150 implies a state in which the latch 150 is pivotally rotated toward the inlet, and a moved away state of latch 150 implies a state in which the latch 150 is pivotally rotated into the outer housing 110.

The latch 150 can make the terminal housing 121 to fasten a coupled state to the inlet or to decouple from the inlet as the terminal housing 121 slides, without any additional locking or unlocking means.

Referring to FIG. 8, if the lever 180 is turned in the first direction, rotating force of the lever 180 turns into driving force of the slider 140, to make the slider 140 to slide forward.

Then, the terminal assembly 120 connected to the slider 140 is projected to an outside of the outer housing 110, enabling electric connection of the terminal assembly 120 to the inlet 24 of the electric vehicle.

In this case, as the terminal housing 121 slides, the latch 150 couples to the inlet 24, and as the slider 140 slides, the locking pin 212 moves into the boss 111. When the slider 140 finishes the slide, the locking pin 212 protects toward the slider 140 again, preventing the slider 140 from sliding backward in a state the slider 140 is coupled to the first hook portion 141.

And, if the terminal assembly 120 is connected to the inlet 24 electrically, the second locking unit 170 couples to the second hook portion 142 of the slider 140 in response to an electric signal, preventing the slider 140 from sliding backward.

Different from this, if the charging is finished, the second locking unit 170 is separated from the second hook portion 142 of the slider 140 in response to an electric signal, and, if the user presses the unlocking button 160, the locking pin 212 is separated from the first hook portion 141 of the slider 140, enabling the slider 140 to slide backward.

And, there may be an elastic member (Not shown) between the lever 180 and the shaft 113, for applying elastic force to the lever 180 to rotate in the second direction to restore an original position.

As has been described, by improving a structure, the connector in an electric vehicle charger related to an embodiment of the present invention can simplify a structure thereof, minimize a number of components, secure reliability in stages of mounting, charging, and coupling/decoupling, and improve durability, a water proof performance, and user's convenience.

The preferred embodiment of the present invention described thus is a disclosure of an illustrative purpose, and various modifications, changes, and addition will be possible without departing from the spirit or scope of the invention by those skilled in this field of art. Thus, it is intended that the present invention covers the modifications, changes, and addition of this invention provided they come within the scope of the appended claims and their equivalents.

For an example, a connector 100 related to another embodiment of the present invention may include an outer housing 110, a terminal assembly 120 including a terminal housing 121 slidably mounted in the outer housing 110 to be movable forward or backward, a handle 130 mounted to the outer housing 110 for receiving a cable C electrically connected to the terminal assembly 120 therein, a slider 140 connected to the terminal assembly 120 and slidably mounted in the outer housing 110 to be movable forward or backward, a lever 180 mounted to the outer housing 110 to be rotatable in a first direction or a second direction for making the slider 140 to move forward or backward, a first locking unit 210 for preventing the slider 140 from moving backward when the slider 140 is moved forward, an unlocking button 160 for separating the first locking unit 210 from the slider 140 by pressing the first locking unit 210, and a latch 150 for selectively coupling the outer housing to an inlet of the electric vehicle as the terminal housing 121 slides.

What is claimed is:

1. A connector in an electric vehicle comprising:

an outer housing;

a terminal assembly including a terminal housing slidably mounted in the outer housing to be movable forward or backward;

a handle mounted to the outer housing for receiving a cable electrically connected to the terminal assembly therein;

a slider connected to the terminal assembly and slidably mounted in the outer housing to be movable forward or backward, a lever mounted to the outer housing to be rotatable in a first direction or a second direction for making the slider to move forward or backward;

a first locking unit for preventing the slider from moving backward when the slider is moved forward;

a second locking unit for securing the slider in response to an electric, signal selectively when the slider is moved forward; and an unlocking button for separating the first locking unit from the slider by pressing the first locking unit.

2. The connector as claimed in claim 1, wherein the first locking unit includes;

a boss in the outer housing, an elastic member in the boss, and a locking pin provided in the boss to be able to reciprocate within the boss owing to the elastic member.

3. The connector as claimed in claim 2, wherein the locking pin reciprocates in a direction perpendicular to a direction of slide of the slider.

4. The connector as claimed in claim 3, wherein the locking pin moves into the boss in a direction of moving away from the slider when the slider slides forward, and, if slide of the slider finishes, the locking pin projects in a direction of slider.

5. The connector as claimed in claim 4, wherein the locking pin is in contact with the slider in a state the locking pin is positioned at a rear side of the slider if the slide of the slider finishes.

6. The connector as claimed in claim 4, wherein the locking pin has a contact surface to the slider when the slider slides formed in a sloped surface, and the slider moves forward in a state the slider is in contact with the sloped surface.

7. The connector as claimed in claim 1, wherein the unlocking button is arranged to pass through a rear end portion of the outer housing so as to be slidable in a direction of slide of the slider, and the unlocking button is projected to an upper side of rear end portion of the outer housing the handle is mounted thereto.

8. The connector as claimed in claim 7, wherein, if the unlocking pin presses the locking pin, the locking pin moves into the boss in order to make the slider movable backward.

9. The connector as claimed in claim 1, wherein the second locking unit is a solenoid.

10. The connector as claimed in claim 9, wherein, if the terminal assembly is connected to the electric vehicle electrically, the solenoid is secured to the slider.

11. The connector as claimed in claim 1, wherein the slider includes;

an inserting slot for inserting a rear portion of the terminal assembly therein, a pass through hole for rotatable mounting of the lever thereto, and a plurality of slide projections for sliding in the outer housing.

12. The connector as claimed in claim 11, wherein the slider further includes a seating portion having a shape which surrounds a portion of each of one pair of power terminals in the terminal assembly.

13. The connector as claimed in claim 12, wherein the slider further includes;

a first hook portion for coupling to the first locking unit, and a second hook portion for coupling to the second locking unit.

14. The connector as claimed in claim 13, wherein the first hook portion is positioned above the seating portion and the second hook portion is positioned below the seating portion.

15. The connector as claimed in claim 1, further comprising a cable holder slidably mounted to a rear end portion of the handle to receive the cable therein.

16. The connector as claimed in claim 15, wherein the cable holder slides toward the handle when the terminal assembly moves forward, and slides in a direction to move away from the handle when the terminal assembly moves backward.

17. The connector as claimed in claim 1, further comprising a latch for selective coupling of the outer housing to the inlet in the electric vehicle.

18. The connector as claimed in claim 17, wherein the latch is pivotally mounted to the outer housing, and the terminal housing has a holding projection extended toward the latch provided thereto, for bringing the holding projection into contact with the latch when the terminal housing slides forward to maintain a coupling state of the latch.

19. The connector as claimed in claim 18, wherein the coupling state of the latch is released if the holding projection is separated from the latch as the terminal housing slides backward.

20. A connector in an electric vehicle charger comprising:

an outer housing;

a terminal assembly including a terminal housing slidably mounted in the outer housing to be movable forward or backward;

a handle mounted to the outer housing for receiving a cable electrically connected to the terminal assembly therein;

a slider connected to the terminal assembly and slidably mounted in the outer housing to be movable forward or backward;

a lever mounted to the outer housing to be rotatable in a first direction or a second direction for making the slider to move forward or backward;

a first locking unit for preventing the slider from moving backward when the slider is moved forward;

an unlocking button for separating the first locking unit from the slider by pressing the first locking unit; and a latch for selectively coupling the outer housing to an inlet of the electric vehicle as the terminal housing slides.

* * * * *